US010997899B1

(12) United States Patent
Bae et al.

(10) Patent No.: US 10,997,899 B1
(45) Date of Patent: May 4, 2021

(54) CLOCK DISTRIBUTION TECHNIQUES FOR MICRO-DRIVER LED DISPLAY PANELS

(71) Applicant: Apple Inc., Cupertino, CA (US)

(72) Inventors: Hopil Bae, Sunnyvale, CA (US); Mahdi Farrokh Baroughi, Santa Clara, CA (US); Mohammad B. Vahid Far, San Jose, CA (US)

(73) Assignee: Apple Inc., Cupertino, CA (US)

( * ) Notice: Subject to any disclaimer, the term of this patent is extended or adjusted under 35 U.S.C. 154(b) by 171 days.

(21) Appl. No.: 15/275,173

(22) Filed: Sep. 23, 2016

Related U.S. Application Data

(60) Provisional application No. 62/273,937, filed on Dec. 31, 2015.

(51) Int. Cl.
*G09G 3/32* (2016.01)
*G09G 3/20* (2006.01)

(52) U.S. Cl.
CPC ..... *G09G 3/32* (2013.01); *G09G 3/2074* (2013.01); *G09G 2300/0452* (2013.01); *G09G 2310/08* (2013.01)

(58) Field of Classification Search
CPC ..... G09G 3/20; G09G 3/2074; G09G 3/2092; G09G 3/2096; G09G 3/32; G09G 3/3266; G09G 2300/04542; G09G 2300/0465; G09G 2300/06; G09G 2300/0404; G09G 2310/0221; G09G 2310/0267; G09G 2310/0281; G09G 2310/0286; G09G 2310/0294; G09G 2310/08; G09G 2330/08; G09G 2330/10; G09G 3/3216; G09G 3/3225; H01L 27/3211; H01L 27/3223; H01L 27/3241; H01L 27/3281; H01L 27/3288; H01L 27/3293; H01L 27/3297; H05B 33/0806
See application file for complete search history.

(56) References Cited

U.S. PATENT DOCUMENTS

| | | | | |
|---|---|---|---|---|
| 8,791,474 | B1 * | 7/2014 | Bibl | G09G 3/2003 257/100 |
| 10,319,278 | B1 * | 6/2019 | Nho | G09G 3/2018 |
| 2002/0000982 | A1 * | 1/2002 | Takagi | G09G 3/32 345/204 |
| 2010/0207848 | A1 * | 8/2010 | Cok | G09G 3/2085 345/76 |
| 2010/0265224 | A1 * | 10/2010 | Cok | G09G 3/3266 345/206 |
| 2014/0225817 | A1 * | 8/2014 | Huang | G09G 3/3677 345/87 |

(Continued)

*Primary Examiner* — Keith L Crawley
(74) *Attorney, Agent, or Firm* — Fletcher Yoder, P.C.

(57) ABSTRACT

An electronic display includes emission clock routing without the use of repeaters. This may be accomplished by providing row drivers for each emission clock signal on opposing edges of the display panel, so that each set of row drivers may provide the emission clock signal to only a portion of the micro-drivers in each row. The array of micro-drivers may be further segmented (e.g., into four or more sections, an alternating pattern, uneven sections, etc.) to provide similar advantages. Furthermore, rather than using multiplexors to provide the emission clock signals to the row drivers, the emission clock may be hardwired to the row drivers. This may reduce the number of pins and support the provision of more phases.

24 Claims, 14 Drawing Sheets

(56) References Cited

U.S. PATENT DOCUMENTS

| | | | | |
|---|---|---|---|---|
| 2017/0004760 | A1* | 1/2017 | Jang | G09G 3/2092 |
| 2017/0025075 | A1* | 1/2017 | Cok | H05B 33/0806 |
| 2017/0061867 | A1* | 3/2017 | Cok | G09G 3/3208 |
| 2017/0186356 | A1* | 6/2017 | Cok | G09G 3/2014 |
| 2017/0187976 | A1* | 6/2017 | Cok | H04N 5/376 |
| 2017/0206845 | A1* | 7/2017 | Sakariya | G09G 3/3426 |

* cited by examiner

CLOCK DISTRIBUTION TECHNIQUES FOR MICRO-DRIVER LED DISPLAY PANELS

CROSS-REFERENCE TO RELATED APPLICATIONS

This application claims the benefit of Provisional Application Ser. No. 62/273,937, filed Dec. 31, 2015, entitled "Clock Distribution Techniques for Micro-Driver LED Display Panels," which is incorporated by reference herein in its entirety.

BACKGROUND

The present disclosure relates generally to techniques for driving a display and, more particularly, to techniques for distributing clock signals over a display panel.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

The emission control for certain types of electronic displays may utilize pulse-width modulation to cause the pixels or sub-pixels to emit various gray levels and luminance values. More specifically, the emission control uses an emission clock, which is a high-speed, non-linear clock, to generate the different gray levels and luminance values using pulse-width modulation. Power consumption, signal integrity, back plane routing, and pin counts are the main concerns when using this type of clock distribution scheme. These concerns are further complicated because multi-phase clocks tend to reduce the creation of artifacts on the display, but more phases lead to more complexity and more lines needed to carry the different phases. Conventionally, an emission clock is distributed vertically in the row drivers with phase rotators between each row and with multiplexors that drive the different clock phases to the various sub-pixels. The emission clock is further distributed horizontally in the micro-drivers in each row with repeaters at each micro-driver to retime the clock and send it to the next micro-driver. This approach tends to benefit signal integrity at the cost of power consumption, pin count, and backplane complexity. Furthermore, having too many repeaters may cause error accumulation, which can manifest itself as duty cycle distortion and latency.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
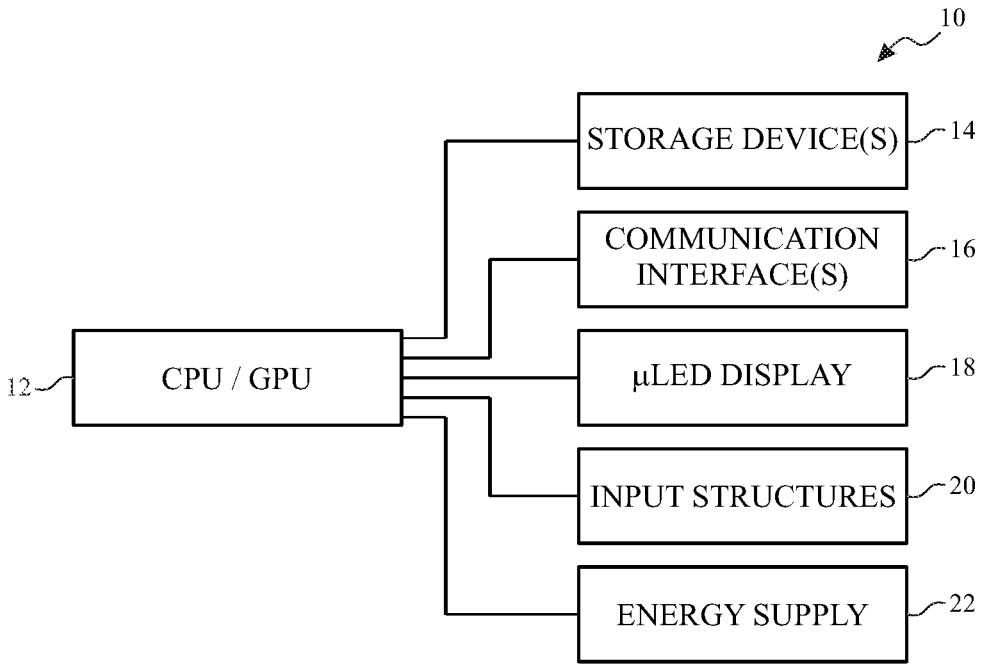
FIG. 1 is a block diagram of components of an electronic device that may include a micro-light-emitting-diode (μ-LED) display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed above, micro-LED displays use an array of micro-drivers to generate different gray-levels, e.g., luminance levels, of corresponding sub-pixels to produce the display images. A high-speed non-linear clock, referred to as an emission clock, is used to generate appropriate pulse-width modulated (PWM) signal to generate these various grey levels. The emission clock produces multi-phase signals to reduce visual artifacts on the display, however, more phases leads to more routing complexity and higher pin counts. Moreover, repeaters are used at each stage to re-time the signal to ensure proper signal integrity, but the repeaters tend to lead to higher pin counts, routing complexity, and power consumption.

To address such concerns, the present techniques described below provide for emission clock routing without the use of repeaters. This may be accomplished, for example, by providing row drivers for each emission clock signal on opposing edges of the display panel, as compared to simply providing row drivers only on one side of the display panel. When row drivers are provided only on one side of the display panel, they must send the emissions clock signal to all of the micro-drivers in the row, so repeaters are necessary due to the length that the signal is being driven. By providing row drivers for the emission clock on opposing sides of the panel, each set of row drivers may provide the emission clock signal to only half of the micro-drivers in each row, for example, thus shortening distance and eliminating the need for repeaters. Indeed, depending on the size of the panel, the number of micro-drivers, and possibly other factors, the array of micro-drivers may be further segmented (e.g., into four or more sections, an alternating pattern, uneven sections, etc.) to provide similar advantages. Furthermore, rather than using multiplexors to provide the emission clock signals to the row drivers, the emission clock may be hardwired to the row drivers. This may reduce the number of pins and support the provision of more phases. Each of these techniques, as well as variations thereof, will be discussed in greater detail below.

Suitable electronic devices that may include a micro-LED (μ-LED) display and corresponding circuitry of this disclosure are discussed below with reference to FIGS. 1-4. One example of a suitable electronic device 10 may include, among other things, processor(s) such as a central processing unit (CPU) and/or graphics processing unit (GPU) 12, storage device(s) 14, communication interface(s) 16, a μ-LED display 18, input structures 20, and an energy supply 22. The blocks shown in FIG. 1 may each represent hardware, software, or a combination of both hardware and software. The electronic device 10 may include more or fewer components. It should be appreciated that FIG. 1 merely provides one example of a particular implementation of the electronic device 10.

The CPU/GPU 12 of the electronic device 10 may perform various data processing operations, including generating and/or processing image data for display on the display 18, in combination with the storage device(s) 14. For example, instructions that can be executed by the CPU/GPU 12 may be stored on the storage device(s) 14. The storage device(s) 14 thus may represent any suitable tangible, computer-readable media. The storage device(s) 14 may be volatile and/or non-volatile. By way of example, the storage device(s) 14 may include random-access memory, read-only memory, flash memory, a hard drive, and so forth.

The electronic device 10 may use the communication interface(s) 16 to communicate with various other electronic devices or components. The communication interface(s) 16 may include input/output (I/O) interfaces and/or network interfaces. Such network interfaces may include those for a personal area network (PAN) such as BLUETOOTH®, a local area network (LAN) or wireless local area network (WLAN) such as WI-FI®, and/or for a wide area network (WAN) such as a long-term evolution (LTE) cellular network.

Using pixels containing an arrangement μ-LEDs, the display 18 may display images generated by the CPU/GPU 12. The display 18 may include touchscreen functionality to allow users to interact with a user interface appearing on the display 18. Input structures 20 may also allow a user to interact with the electronic device 10. For instance, the input structures 20 may represent hardware buttons. The energy supply 22 may include any suitable source of energy for the electronic device. This may include a battery within the electronic device 10 and/or a power conversion device to accept alternating current (AC) power from a power outlet.

Figure 2:
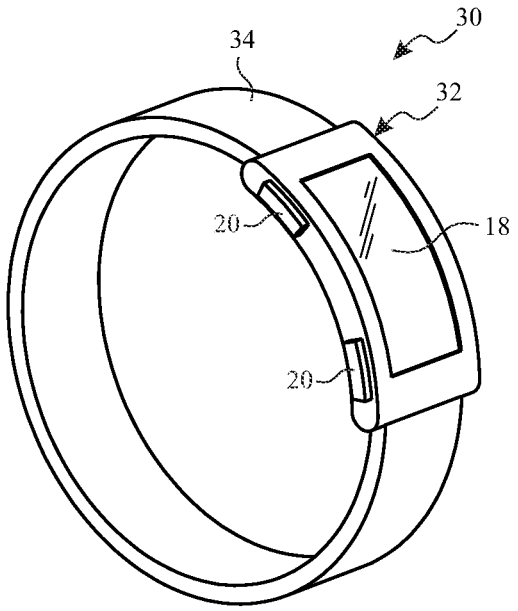
FIG. 2 is a perspective view of the electronic device in the form of a fitness band, in accordance with an embodiment.
Figure 3:
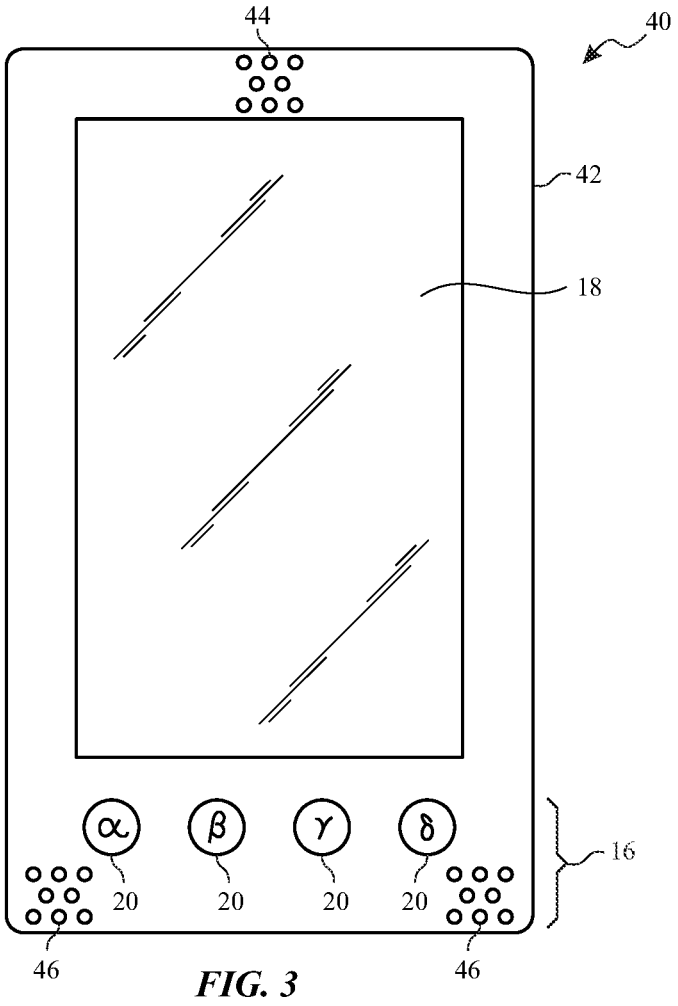
FIG. 3 is a front view of the electronic device in the form of a slate, in accordance with an embodiment.
Figure 4:
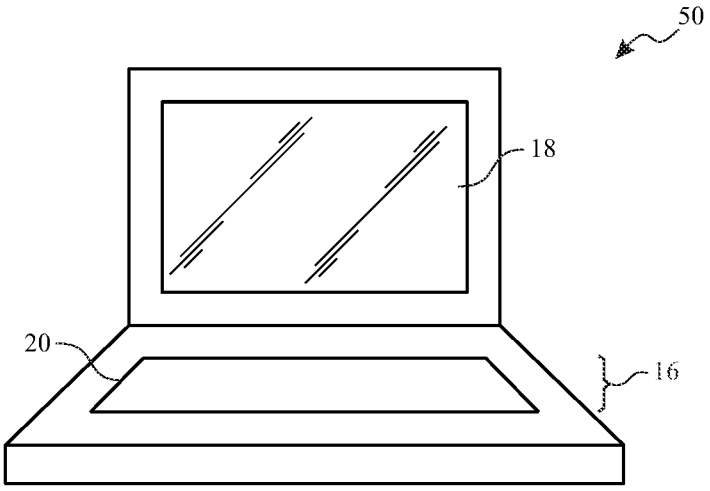
FIG. 4 is a perspective view of the electronic device in the form of a notebook computer, in accordance with an embodiment.

As may be appreciated, the electronic device 10 may take a number of different forms. As shown in FIG. 2, the electronic device 10 may take the form of a wearable electronic device, such as a fitness band 30. The fitness band 30 may include an enclosure 32 that houses the electronic device 10 components of the fitness band 30. A strap 30 may allow the fitness band 30 to be worn on the arm or wrist. The display 18 may display information related to the fitness band operation. Additionally or alternatively, the fitness band 30 may operate as a watch, in which case the display 18 may display the time. Input structures 20 may allow a person wearing the fitness band 30 navigate a graphical user interface (GUI) on the display 18.

The electronic device 10 may also take the form of a slate 40. Depending on the size of the slate 40, the slate 40 may serve as a handheld device such as a mobile phone. The slate 40 includes an enclosure 42 through which several input structures 20 may protrude. The enclosure 42 also holds the display 18. The input structures 20 may allow a user to interact with a GUI of the slate 40. For example, the input structures 20 may enable a user to make a telephone call. A speaker 44 may output a received audio signal and a microphone 46 may capture the voice of the user. The slate 40 may also include a communication interface 16 to allow the slate 40 to connect via a wired or wireless connection to another electronic device.

A notebook computer 50 represents another form that the electronic device 10 may take. It should be appreciated that the electronic device 10 may also take the form of any other computer, including a desktop computer. The notebook computer 50 shown in FIG. 4 includes the display 18 and input structures 20 that include a keyboard and a track pad. Communication interfaces 16 of the notebook computer 50 may include, for example, a universal service bus (USB) connection.

Figure 5:
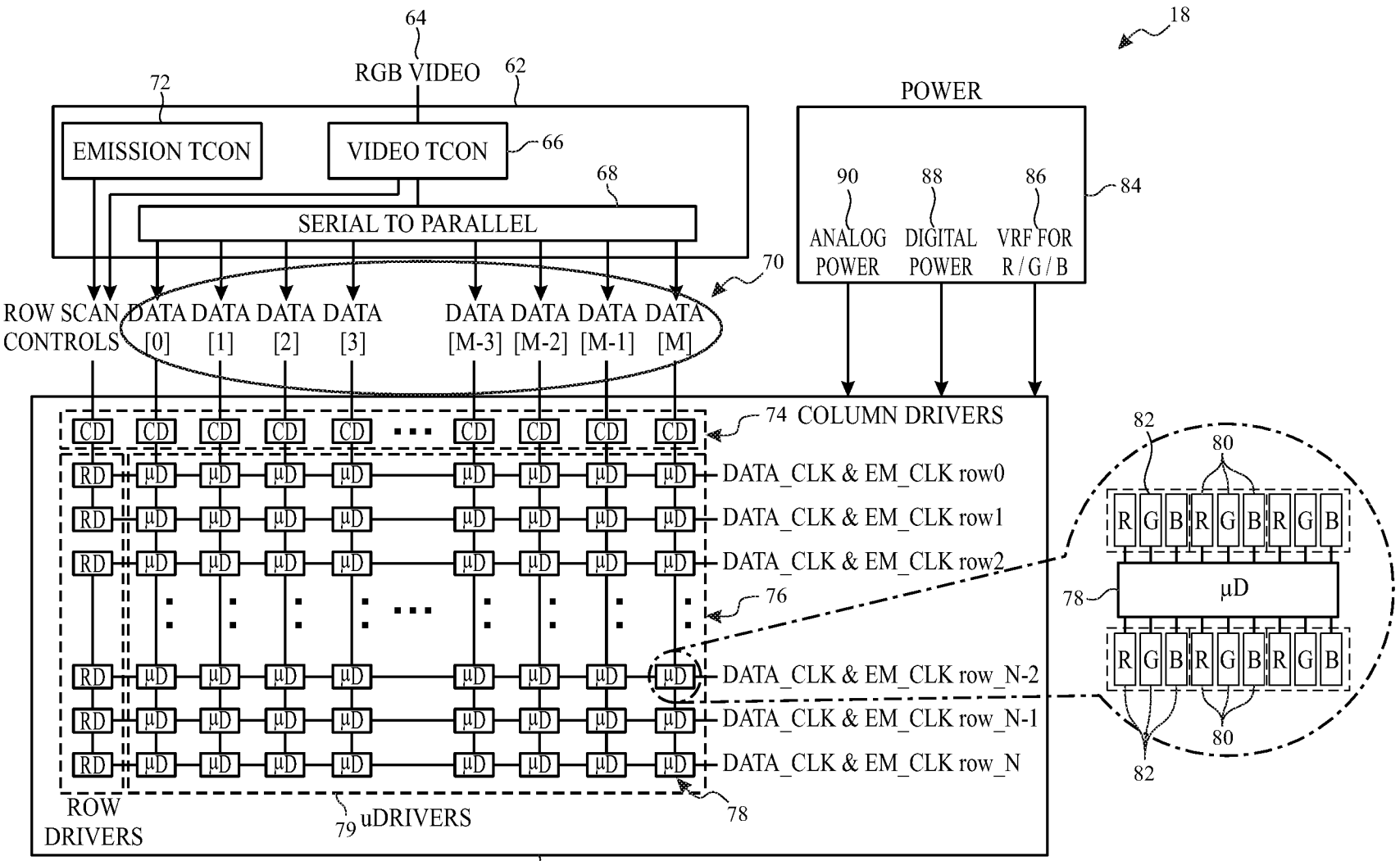
FIG. 5 is a block diagram of a μ-LED display that employs micro-drivers (μDs) to drive μ-LED subpixels with controls signals from row drivers (RDs) and data signals from column drivers (CDs), in accordance with an embodiment.

A block diagram of the architecture of the μ-LED display 18 appears in FIG. 5. In the example of FIG. 5, the display 18 uses an RGB display panel 60 with pixels that include red, green, and blue μ-LEDs as subpixels. Support circuitry 62 may receive RGB-format video image data 64. It should be appreciated, however, that the display 18 may alternatively display other formats of image data, in which case the support circuitry 62 may receive image data of such different image format. In the support circuitry 62, a video timing controller (TCON) 66 may receive and use the image data 64 in a serial signal to determine a data clock signal (DATA_CLK) to control the provision of the image data 64 in the display 18. The video TCON 66 also passes the image data 64 to serial-to-parallel circuitry 68 that may deserialize the image data 64 signal into several parallel image data signals 70. That is, the serial-to-parallel circuitry 68 may collect the image data 64 into the particular data signals 70 that are passed on to specific columns among a total of M respective columns in the display panel 60. As such, the data 70 is labeled DATA[0], DATA[1], DATA[ ], DATA[3] . . . DATA [M−3], DATA[M−2], DATA[M−1], and DATA[M]. The data 70 respectively contain image data corresponding to pixels in the first column, second column, third column, fourth column . . . fourth-to-last column, third-to-last column, second-to-last column, and last column, respectively. The data 70 may be collected into more or fewer columns depending on the number of columns that make up the display panel 60.

As noted above, the video TCON 66 may generate the data clock signal (DATA_CLK). An emission timing controller (TCON) 72 may generate an emission clock signal (EM_CLK). Collectively, these may be referred to as Row Scan Control signals, as illustrated in FIG. 5. These Row Scan Control signals may be used by circuitry on the display panel 60 to display the image data 70.

In particular, the display panel 60 includes column drivers (CDs) 74, row drivers (RDs) 76, and micro-drivers (μDs or uDs) 78. The uDs 78 are arranged in an array 79. Each uD 78 drives a number of pixels 80 having μ-LEDs as subpixels 82. Each pixel 80 includes at least one red μ-LED, at least one green μ-LED, and at least one blue μ-LED to represent the image data 64 in RGB format. Although the uDs 78 of FIG. 5 is shown to drive six pixels 80 having three subpixels 82 each, each μD 78 may drive more or fewer pixels 80. For example, each μD 78 may respectively drive 1, 2, 3, 4, 5, 6, 7, 8, 9, 10, 11, 12, or more pixels 80.

A power supply 84 may provide a reference voltage (VREF) 86 to drive the μ-LEDs, a digital power signal 88, and an analog power signal 90. In some cases, the power supply 84 may provide more than one reference voltage (VREF) 86 signal. Namely, subpixels 82 of different colors may be driven using different reference voltages. As such, the power supply 84 may provide more than one reference voltage (VREF) 86. Additionally or alternatively, other circuitry on the display panel 60 may step the reference voltage (VREF) 86 up or down to obtain different reference voltages to drive different colors of μ-LED.

To allow the μDs 78 to drive the μ-LED subpixels 82 of the pixels 80, the column drivers (CDs) 74 and the row drivers (RDs) 76 may operate in concert. Each column driver (CD) 74 may drive the respective image data 70 signal for that column in a digital form. Meanwhile, each RD 76 may provide the data clock signal (DATA_CLK) and the emission clock signal (EM_CLK) at an appropriate to activate the row of μDs 78 driven by the RD 76. A row of μDs 78 may be activated when the RD 76 that controls that row sends the data clock signal (DATA_CLK). This may cause the now-activated μDs 78 of that row to receive and store the digital image data 70 signal that is driven by the column drivers (CDs) 74. The μDs 78 of that row then may drive the pixels 80 based on the stored digital image data 70 signal based on the emission clock signal (EM_CLK).

Figure 6:
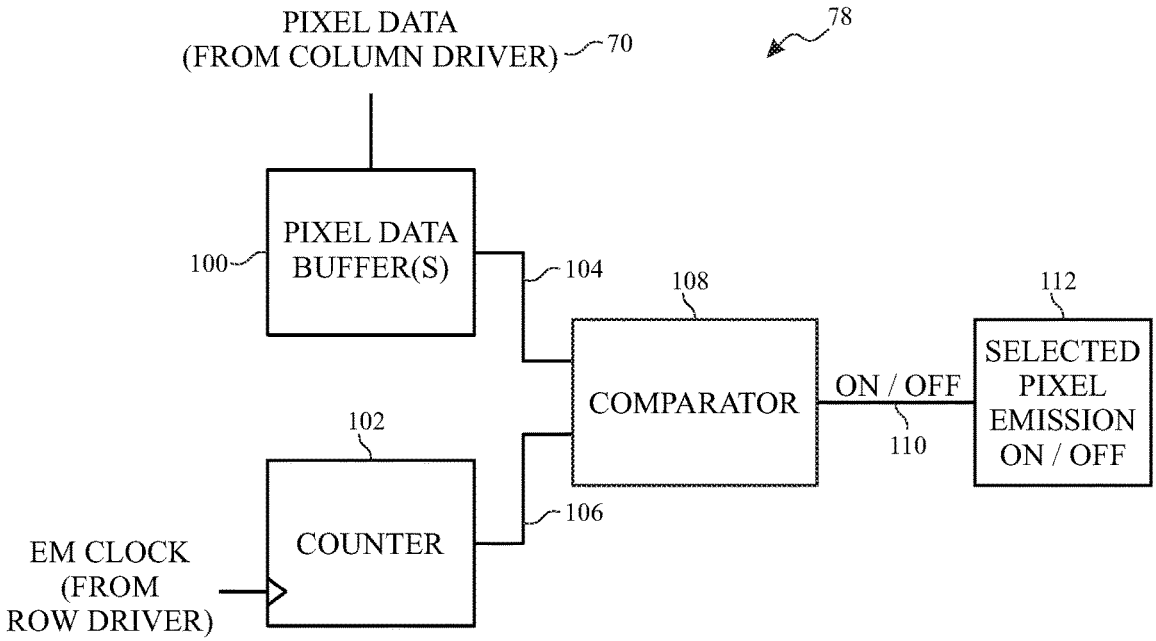
FIG. 6 is a block diagram schematically illustrating an operation of one of the micro-drivers (μDs), in accordance with an embodiment.

A block diagram shown in FIG. 6 illustrates some of the components of one of the μDs 78. The μD 78 shown in FIG. 6 includes pixel data buffer(s) 100 and a digital counter 102. The pixel data buffer(s) 100 may include sufficient storage to hold the image data 70 that is provided. For instance, the μD 78 may include pixel data buffers to store image data 70 for three subpixels 82 at any one time (e.g., for 8-bit image data 70, this may be 24 bits of storage). It should be appreciated, however, that the μD 78 may include more or fewer buffers, depending on the data rate of the image data 70 and the number of subpixels 82 included in the image data 70. The pixel data buffer(s) 100 may take any suitable logical structure based on the order that the column driver (CD) 74 provides the image data 70. For example, the pixel data buffer(s) 100 may include a first-in-first-out (FIFO) logical structure or a last-in-first-out (LIFO) structure.

When the pixel data buffer(s) 100 has received and stored the image data 70, the RD 76 may provide the emission clock signal (EM_CLK). A counter 102 may receive the emission clock signal (EM_CLK) as an input. The pixel data buffer(s) 100 may output enough of the stored image data 70 to output a digital data signal 104 represent a desired gray level for a particular subpixel 82 that is to be driven by the μD 78. The counter 102 may also output a digital counter signal 106 indicative of the number of edges (only rising, only falling, or both rising and falling edges) of the emission clock signal (EM_CLK) 98. The signals 104 and 106 may enter a comparator 108 that outputs an emission control signal 110 in an "on" state when the signal 106 does not exceed the signal 104, and an "off" state otherwise. The emission control signal 110 may be routed to driving circuitry (not shown) for the subpixel 82 being driven, which may cause light emission 112 from the selected subpixel 82 to be on or off. The longer the selected subpixel 82 is driven "on" by the emission control signal 110, the greater the amount of light that will be perceived by the human eye as originating from the subpixel 82.

Figure 7:
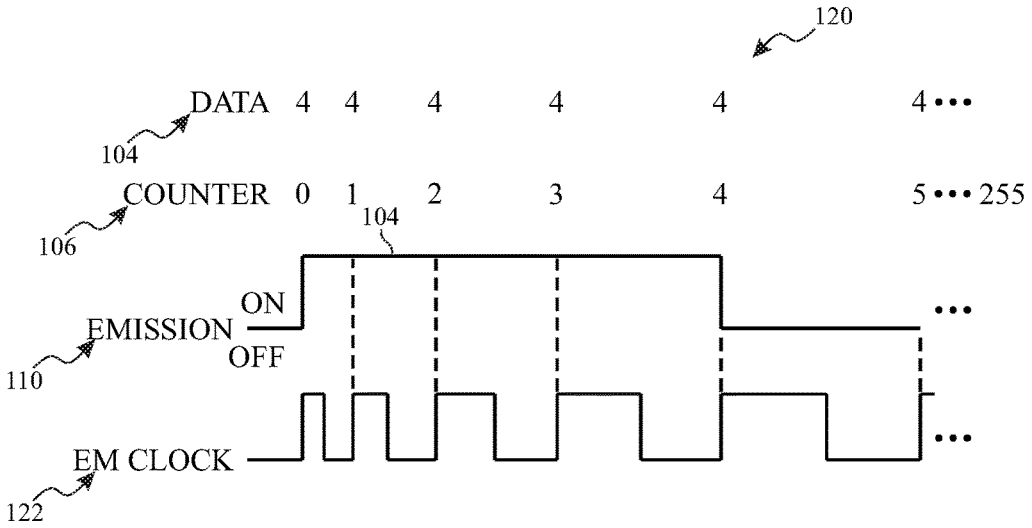
FIG. 7 is a timing diagram illustrating an example operation of the micro-driver (μD) of FIG. 6, in accordance with an embodiment.

A timing diagram 120, shown in FIG. 7, provides one brief example of the operation of the μD 78. The timing diagram 120 shows the digital data signal 104, the digital counter signal 106, the emission control signal 110, and the emission clock signal (EM_CLK) represented by numeral 122. In the example of FIG. 7, the gray level for driving the selected subpixel 82 is gray level 4, and this is reflected in the digital data signal 104. The emission control signal 110 drives the subpixel 82 "on" for a period of time defined as gray level 4 based on the emission clock signal (EM_CLK). Namely, as the emission clock signal (EM_CLK) rises and falls, the digital counter signal 106 gradually increases. The comparator 108 outputs the emission control signal 110 to an "on" state as long as the digital counter signal 106 remains less than the data signal 104. When the digital counter signal 106 reaches the data signal 104, the comparator 108 outputs the emission control signal 110 to an "off" state, thereby causing the selected subpixel 82 no longer to emit light.

It should be noted that the steps between gray levels are reflected by the steps between emission clock signal (EM_CLK) edges. That is, based on the way humans perceive light, to notice the difference between lower gray levels, the difference between the amount of light emitted between two lower gray levels may be relatively small. To notice the difference between higher gray levels, however, the difference between the amount of light emitted between two higher gray levels may be comparatively much greater. The emission clock signal (EM_CLK) therefore may use relatively short time intervals between clock edges at first. To account for the increase in the difference between light emitted as gray levels increase, the differences between edges (e.g., periods) of the emission clock signal (EM_CLK) may gradually lengthen. The particular pattern of the emission clock signal (EM_CLK), as generated by the emission TCON 72, may have increasingly longer differences between edges (e.g., periods) so as to provide a gamma encoding of the gray level of the subpixel 82 being driven.

Figure 8:
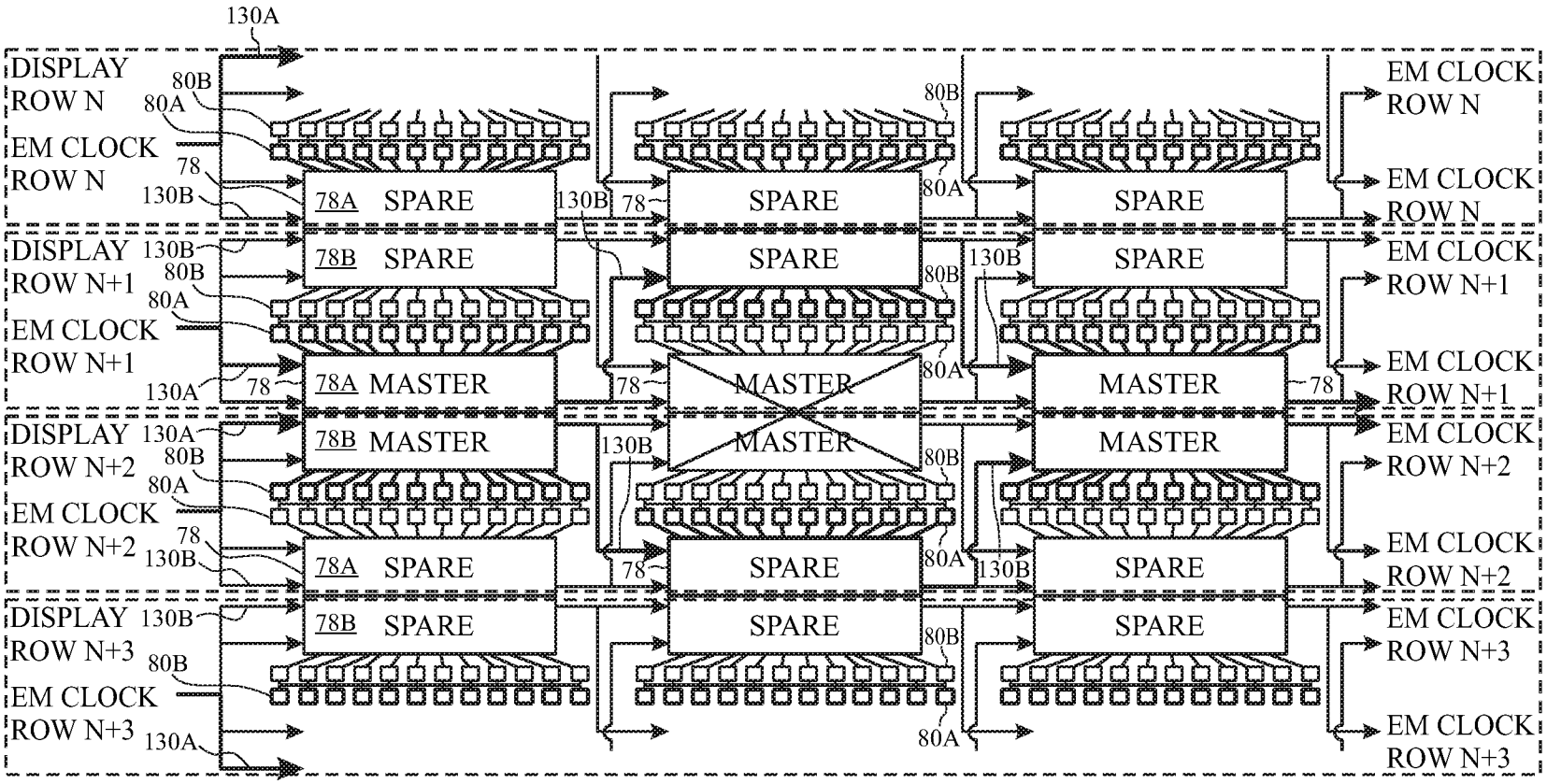
FIG. 8 is a detailed view a section of a micro-driver array illustrating the present emission clock distribution and redundancy scheme.

It should be appreciated that since each μD 78 is a small integrated circuit that is typically placed on the display panel 60 by a pick-and-place machine so that it can make the appropriate connections with the plurality of sub-pixels 72 which are similarly placed on the display panel 60. Occasionally, some of the μDs 78 do not function properly. Hence, as illustrated in FIG. 8, each μD 78 may include a pair of μD circuits 78A and 78B, each of which is configured to drive a separate set of pixels 80A and 80B, respectively. As shown in FIG. 8, the μD 78 may be arranged such that one row of μDs 78 may be designated as the primary or master drivers, while alternating rows may be designated as secondary or spare drivers that would typically only be used if the primary or master driver failed. The separate sets of pixels 80A and 80B may be arranged adjacent to one another so that if the master μD 78 fails and cannot drive its set of pixels 80A, the spare μD 78 may be used to drive the set of pixels 80B. Because the separate sets of pixels 80A and 80B are located adjacent to one another, the human eye cannot discern that there is any ambiguity in the image that is produced.

However, this redundancy scheme introduces some complexity for distribution of the emission clock. More specifically, each μD 78 includes a repeater that receives and amplifies the emission clock signal prior to forwarding it to the next μD 78. As a result, conductive paths must exist to route the emissions clock for each row to not only the master μD 78A, but also the spare μD 78B. For example, the emission clock for each row includes a primary path 130A that delivers the emission clock signal to each master driver and a secondary path 130B that delivers the emission clock signal to each spare driver. As can be seen by the example of FIG. 8, when the center master μD 78 fails, the emission clock signal from the preceding master μD 78 must be routed via the paths 130B to the adjacent spare μD 78 before being routed again to the next functional master μD 78.

Figure 9:
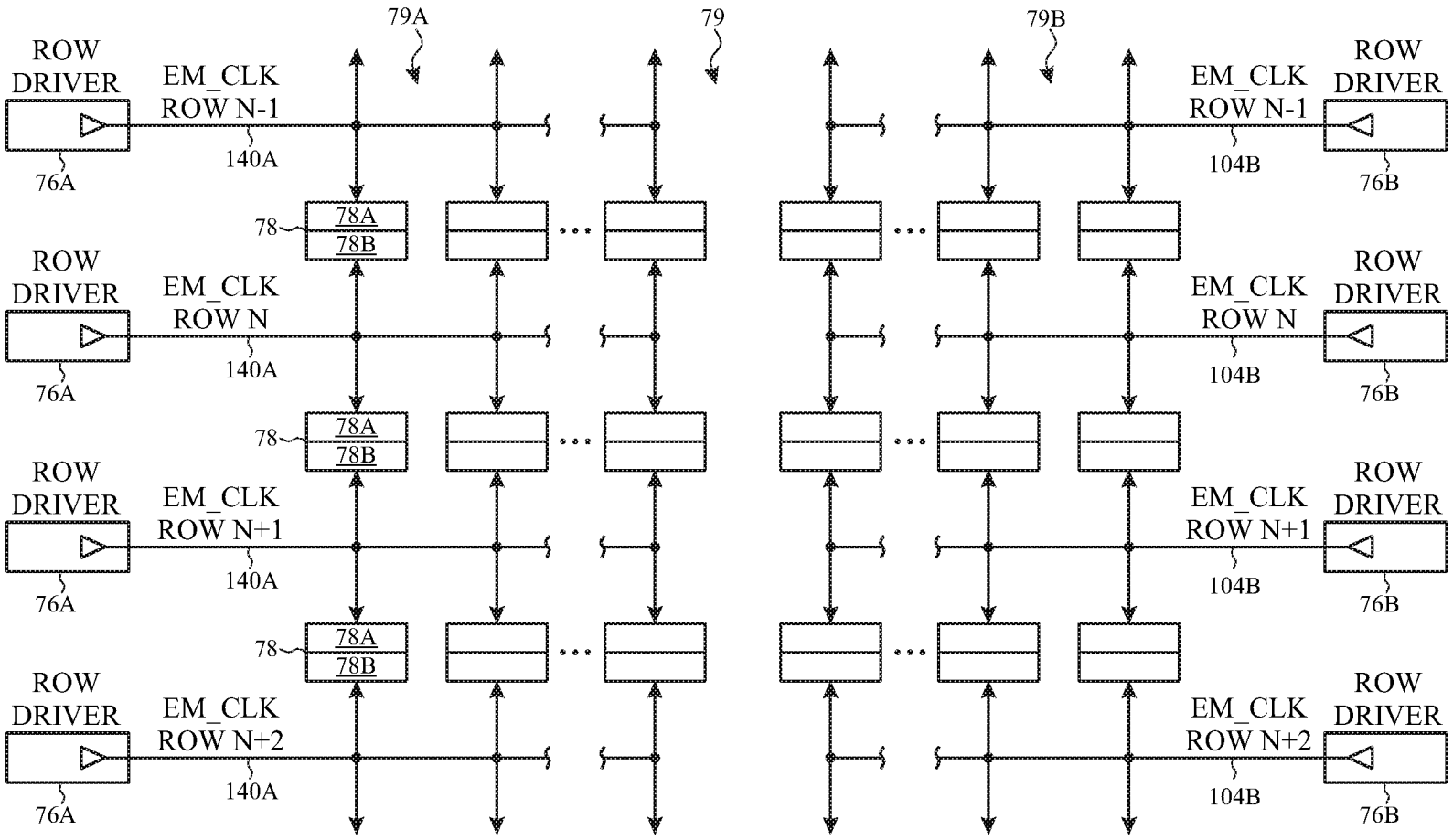
FIG. 9 illustrates a portion of a micro-driver array with emission clock drivers on both sides of the display panel.

If each μD 78 did not use a repeater to forward the emission clock signal to the next μD 78, the routing for the emission clock could be substantially simplified. One technique for accomplishing this is to reduce the path length that the emission clock signal must travel to obviate the need for any repeaters. For example, as illustrated in FIG. 9, rather than having a column of row drivers on one side of the display panel 60 to generate the emission clock signal by each μD 78 in the row (as discussed above with regard to FIG. 8), a column of row drivers 76A may be provided along one side of the display panel 60 and another column of row drivers 76B may be provided along another side of the display panel 60. The array 79 of μDs 78 may be split into two pieces so that the column of row drivers 76A provides emission clock signals to μD 78 in the first section 79A of the array 79 and the second column of row drivers 76B provides emission clock signals to the μDs 78 to the second section 79B of the array 79. Because repeaters are not used in μDs 78 to pass the emission clock signal from one μD 78 to the next, simple conductive paths 140A and 140B may be utilized to deliver each emission clock signal both the master and slave μDs 78 in each of the respective sections 79A and 79B of the array 79. Indeed, while the emission clock routing in FIG. 8 is essentially a serial routing scheme where the emission clock signal is routed from one μD 78 to the next, the emission clock routing scheme in FIG. 9 is essentially a parallel routing scheme where the emission clock signal is routed to the μDs 78 in each row substantially simultaneously.

Figure 10:
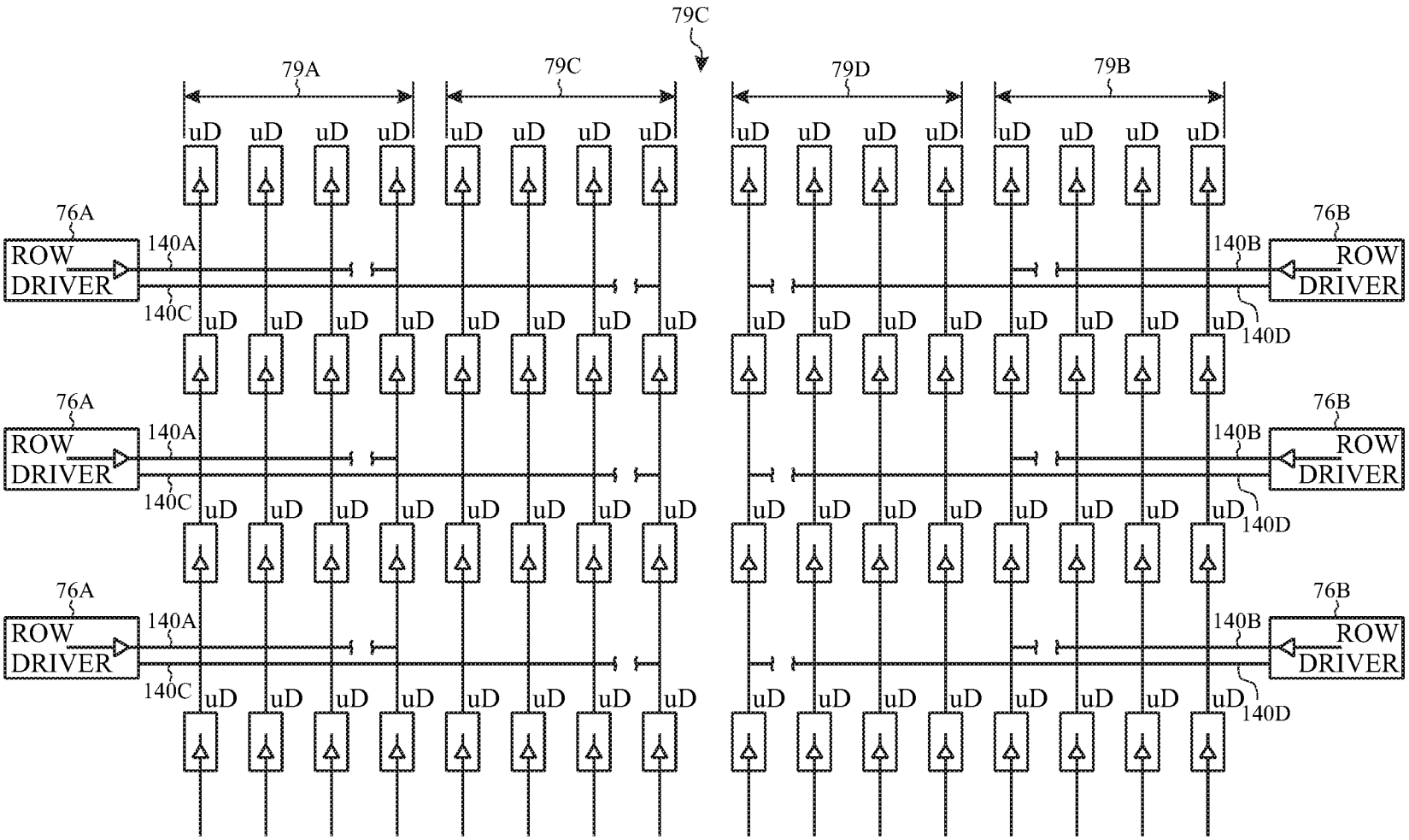
FIG. 10 is an alternate view a portion of a micro-driver array with emission clock drivers on each side of the display panel, where the micro-driver array is segmented into four sections.

Of course, the manner in which the array 79 of μDs 78 may be segmented to obviate the need for repeaters and to facilitate the use of a parallel routing scheme depends upon a number of factors, including, for example, the strength of the emission clock signal, power consumption constraints of display panel 60, the number of μDs 78 and/or pixels 80, the size of the display panel 60, among other things. For example, as illustrated in FIG. 10, an array 79 of μDs 78 may be essentially separated into half, where the first half includes sections 79A and 79C and where the second half includes sections 79B and 79D. In this example, the first column of row drivers 78A drive the emission clock signal on the path 140A to μDs 78 in section 79A and drive the emission clock signal on a second path 140C to μDs 78 in section 79C. Similarly, the column of row drivers 76B drive the emission clock signal on the path 140B to μDs 78 in section 79B and drive the emission clock signal on the path 140D to μDs 78 in section 79D. Each of the sections 79A-D may be of the same or substantially the same size, e.g., each may be a quarter of the overall array 79, or the sections 79A-D may be of different sizes. For example, the sections 79A and 79B may be slightly larger than the sections 79C and 79D because they are closer to their respective row drivers 76A and 76B.

Figure 11:
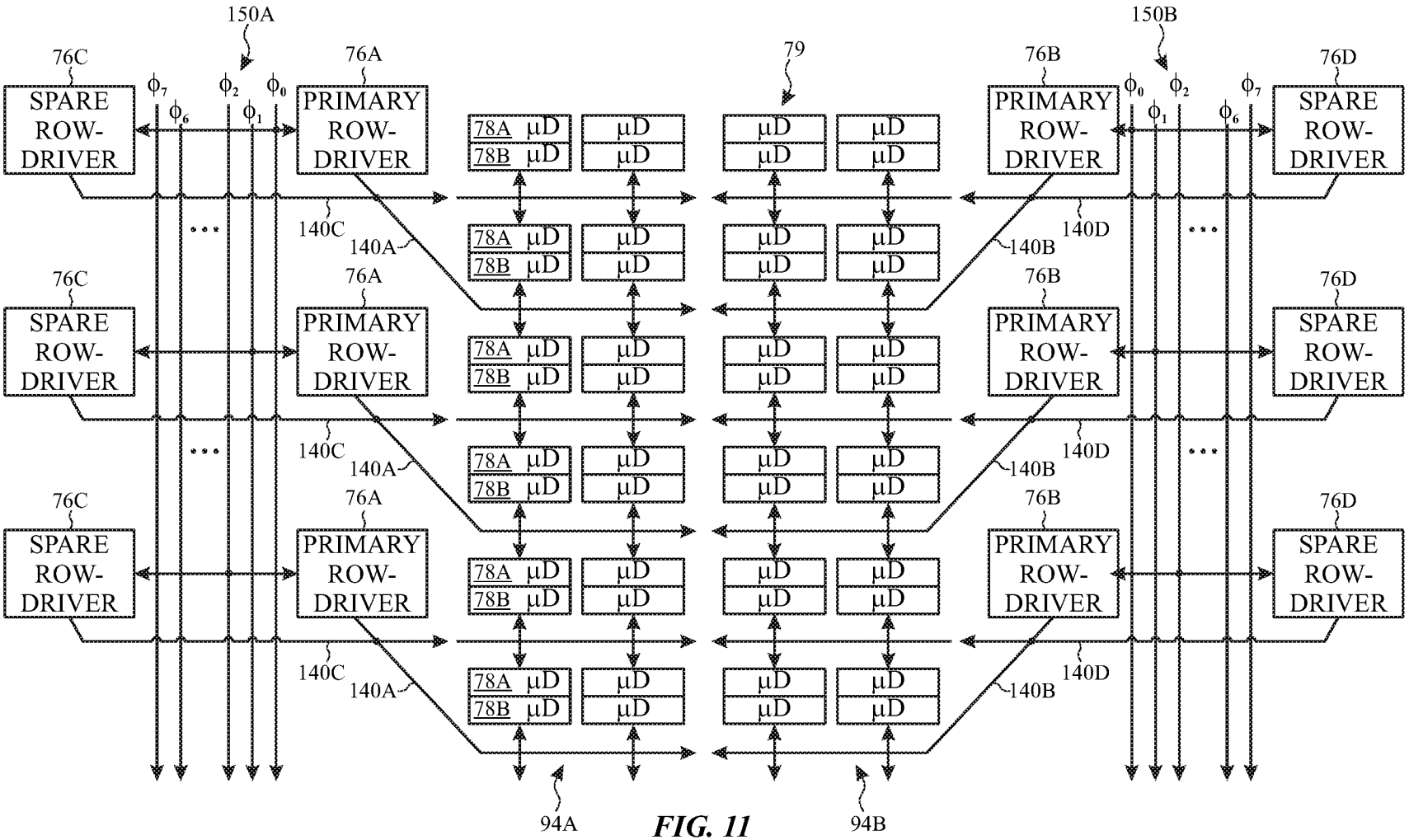
FIG. 11 is a view of a section of micro-drivers having primary row drivers and spare row drivers on each side of the display panel.

The above discussion has been primarily focused on techniques to simplify routing of emission clock signals in a display panel 60 that utilizes only a primary row driver 76 with redundant μDs 78 for each row. However, it should be appreciated that just as certain μDs 78 may fail to operate properly, certain row drivers 76 may also fail to operate properly. Hence, in some circumstances it may be desirable to provide not only redundant μDs 78 but also redundant row drivers 76. One example of such a technique is illustrated in FIG. 11. As shown, this particular scheme, including the primary row drivers 76A and 76B arranged to drive the respective sections 79A and 79B of μDs 78A and 78B, is similar to the scheme discussed above with regard to FIG. 9. However, this scheme further includes a column of spare row drivers 76C arranged alongside the column of primary row drivers 76A, as well as a column of spare row drivers 76D arranged alongside the column of primary row drivers 76B. The various phases of the emission clock are provided to the primary and spare row drivers 76A and 76C via lines 150A and to the primary and spare row drivers 76B and 76D via lines 150B. In this example, the lines 150A and 150B include eight lines apiece to carry the eight phases $\varphi 0$-$\varphi 7$, though it should be appreciated that any suitable number of phases may be used. Because each of the conductive paths 140A is coupled to their respective conductive paths 140C and because each of the conductive paths 140B is coupled to their respective conductive paths 140D, if one of the primary row drivers 76A or 76B is non-functional for some reason, the respective spare row driver 76C or 76D may be used to provide the appropriate emission clock signal to the appropriate row of μDs 78.

Figure 12:
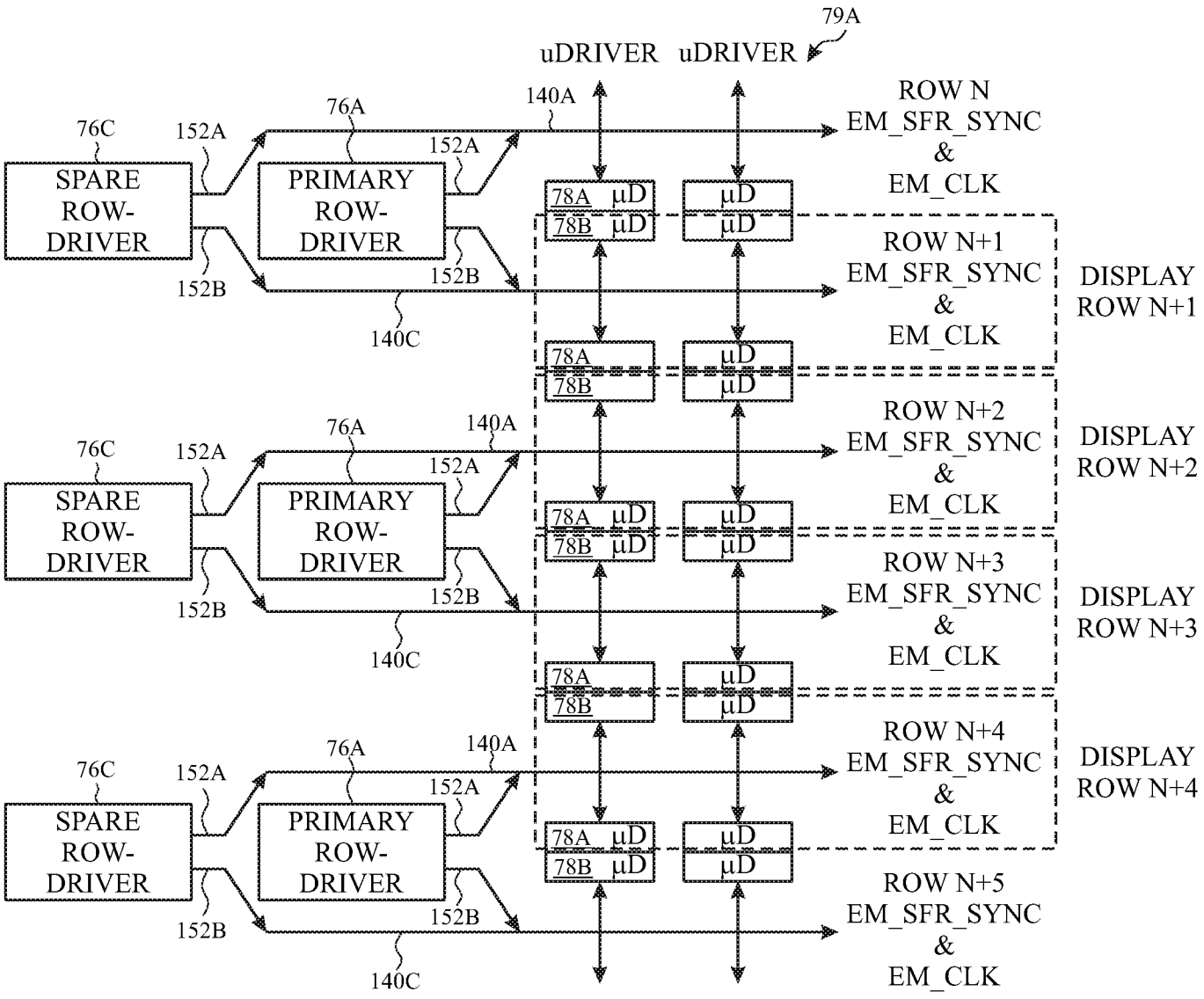
FIG. 12 is an alternate embodiment of the driving scheme of FIG. 11 using redundant primary and spare row drivers for the emission clock.

Another connection scheme for an array 79 having both redundant μDs 78A and 78B along with redundant row drivers 76A and 76C is illustrated in FIG. 12, as a portion of section 79A. Similar to the scheme illustrated in FIG. 11, the column of spare row drivers 76C is arranged adjacent the column of primary row drivers 76A. In this scheme, however, conductive paths 140 extend between each of the μDs 78 so that either the master μD or spare μD may be used to illuminate its respective set of pixels 80 (not shown). Both the primary row drivers 76A and the spare row drivers 76C include dual outputs 152A and 152B that provide their respective emission clock signal to the respective conductive paths 140A and 140C.

Figure 13:
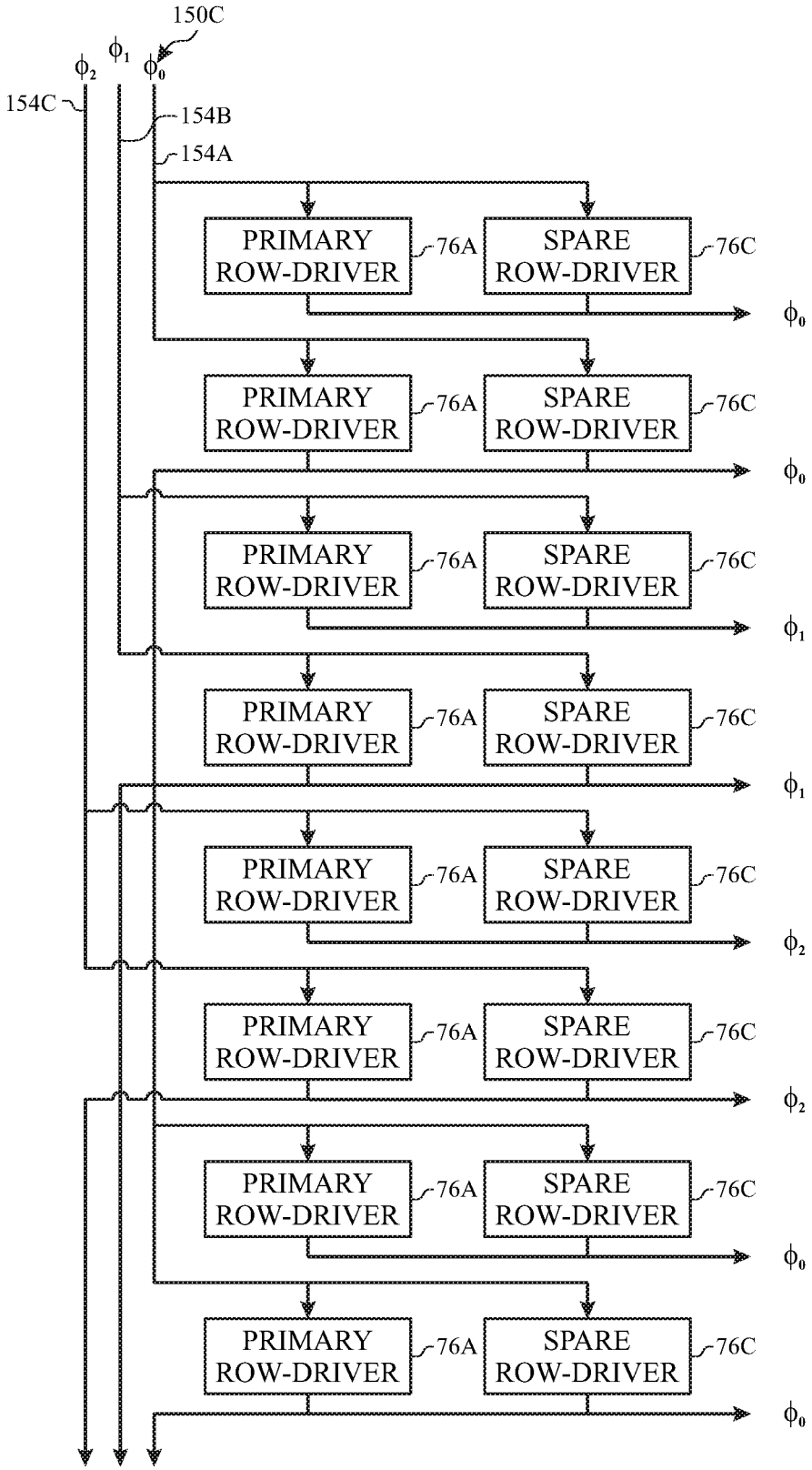
FIG. 13 is a block diagram of a hardwired emissions clock driving scheme using primary and spare row drivers.

Further, as mentioned above, to reduce the number of pins and to support the provision of more clock phases, the emission clock may be hardwired to the row drivers 76 instead of using multiplexors. Such a technique is illustrated in FIG. 13. In this example, the emission clock signals on the lines 150C are provided to a plurality to primary row drivers 76A and spare row drivers 76C. As can be seen, the emission clock includes three phases $\varphi_0$, $\varphi_1$, $\varphi_2$, though these techniques may be utilized with an emission clock including any suitable number of phases. The first phase $\varphi_0$ of the emission clock is provided on line 154A to the first two sets of primary row drivers 76A and spare row drivers 76C, which drive the primary row of μDs 78 and secondary row of μDs 78 (not shown), respectively. It should be noted that the first phase $\varphi_0$ of the emission clock is also delivered to the last two illustrated sets of the primary row drivers 76A and secondary row drivers 76C so that the first phase $\varphi_0$ is available to be delivered to those respective rows of μD 78 (not shown). Similarly, the second phase $\varphi_1$ emission clock is delivered to its respective two sets of primary row drivers 76A and spare row drivers 76C on line 154B, and the third phase $\varphi_2$ of the emission clock is delivered to its respective two sets of primary row drivers 76A and spare row drivers 76C on line 154C. Also similarly, the second phase $\varphi_1$ and third phase $\varphi_2$ are delivered to the next respective sets of primary row drivers 76A and spare row drivers 76C (not shown). Indeed, this clock distribution scheme extends the length of the column of primary row drivers 76A and spare row drivers 76C to provide the various phases of the emission clock to all of the row drivers 76 in the column. The various phases of the emission clock may also be provided in a similar fashion to an opposed column of row drivers (not shown).

Figure 14:
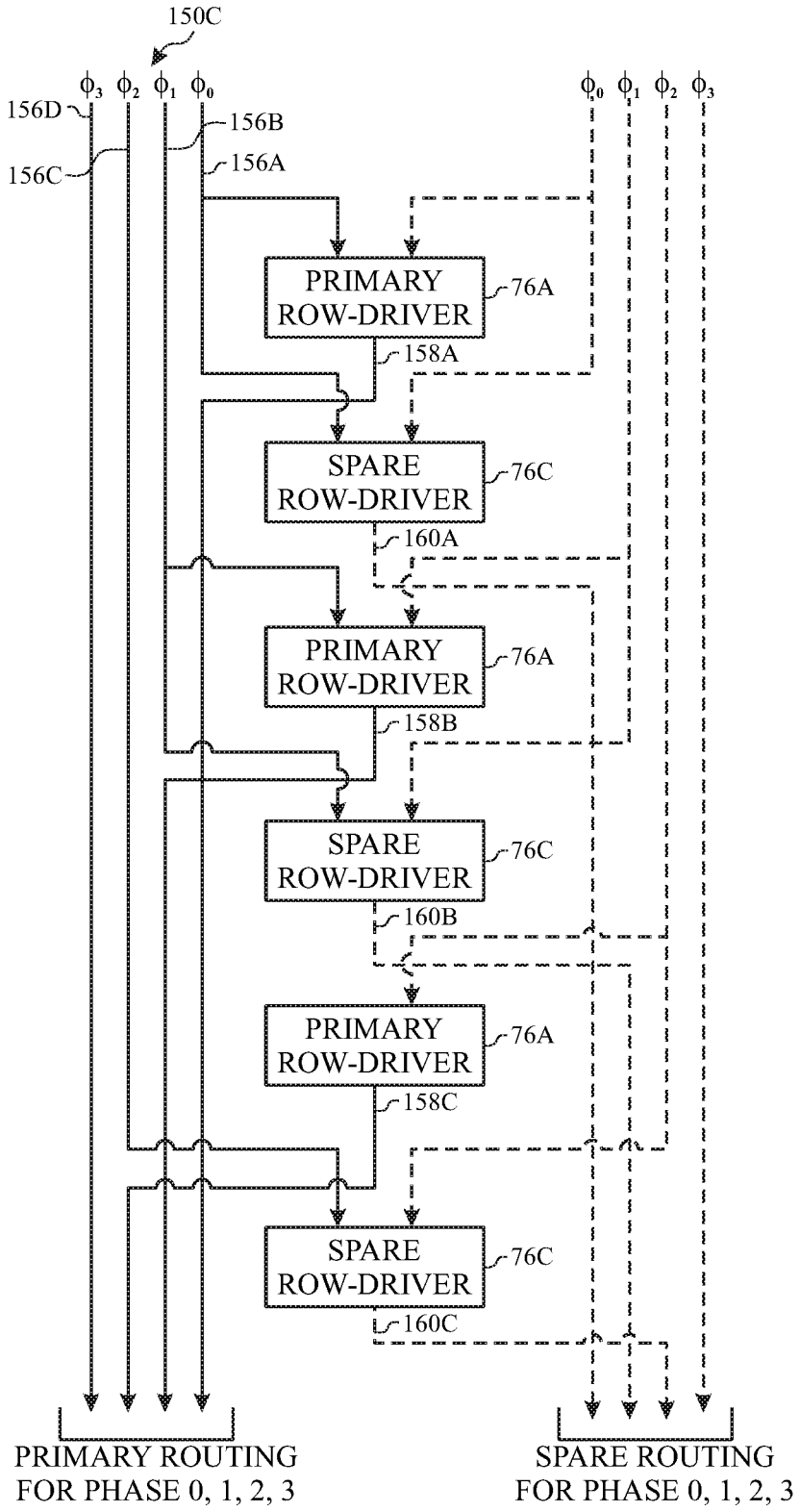
FIG. 14 is a variant of the driving scheme illustrated in FIG. 13 where the primary and spare row drivers are positioned alternately in the same column, as opposed to side-by-side.

Another variant of this technique is illustrated in FIG. 14. In this example, rather than having a column of primary row drivers 76A and an adjacent column of spare row drivers 76C, the primary row drivers 76A and the spare row drivers 76C are arranged in a single column in an alternating fashion. In this example, an emission clock having four phases $\varphi_0$, $\varphi_1$, $\varphi_2$, and $\varphi_3$ is provided on lines 150D. As can be seen, the first phase $\varphi_1$ is provided to the first primary row driver 76A and the first spare row driver 76C on line 156A, and the first phase $\varphi_1$ is delivered to the next appropriate primary row driver 76A and spare row driver 76C on line 158A. The remaining phases $\varphi_1$, $\varphi_2$, and $\varphi_3$, are provided to their respective primary row drivers 76A and secondary row drivers 76C on lines 156B, 156C, and 156D, respectively, and those phases are delivered from the respective primary row driver 76A to the next appropriate primary row driver 76A and spare row driver 76C via the respective lines 158B and 158C. Furthermore, spare routing of the four phases $\varphi_0$, $\varphi_1$, $\varphi_2$, and $\varphi_3$ of the emission clock may be provided on lines 150E. These emission clock signals are provided in a similar fashion using lines 156E, 156F, 156G, and 156H, along with lines 160A, 160B and 160C from the spare row driver 76C.

Figure 15:
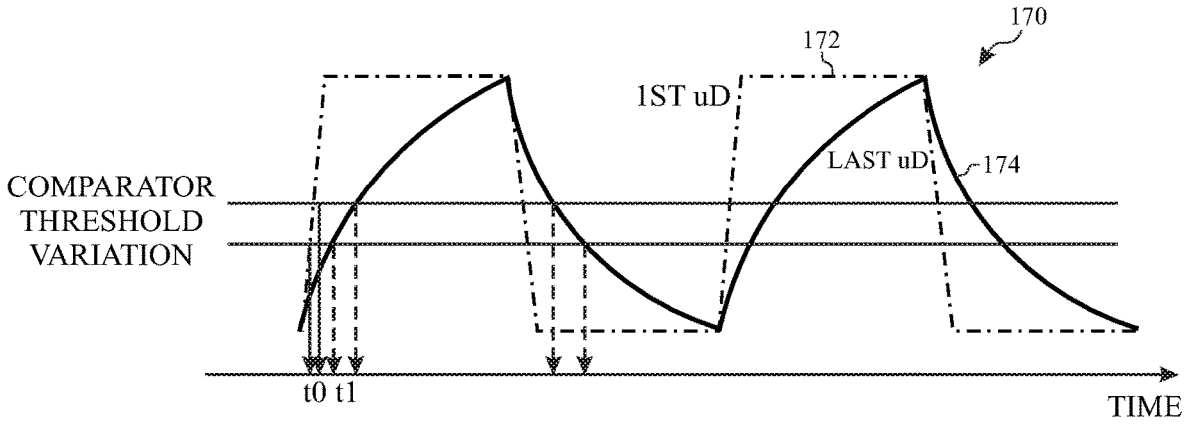
FIG. 15 is a diagram illustrating duty clock variation in a row driver.

Regardless of which of the above techniques are used, it should be understood that the emission clock signal may experience duty cycle variation in the row drivers 76 as the emission clock signal travels from the first μD 78 in a row to the last μD 78 in the row. This duty cycle variation may be illustrated by the graph 170 in FIG. 15, where the emission clock signal may resemble the waveform 172 at the first μD 78 in the row and resemble the waveform 174 at the last μD 78 in the row. As can be seen, this creates a comparator threshold variation which may affect the timing of the drive signals from the respective μDs 78 as the emission clock signal propagates down the row.

Figure 16:
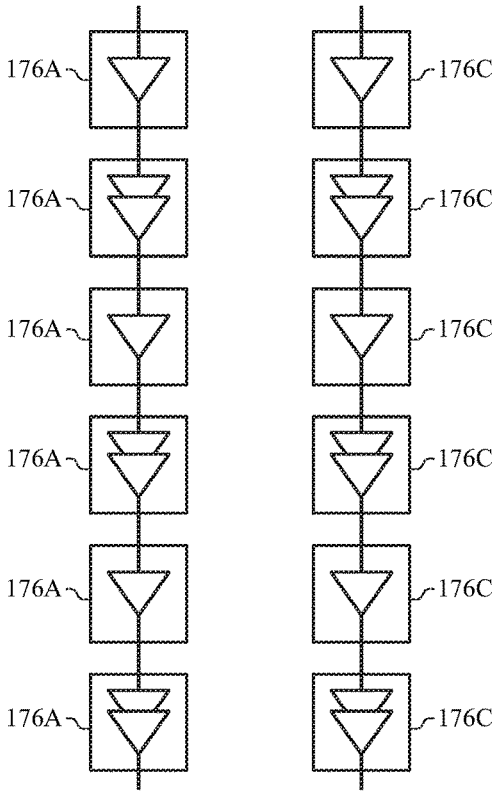
FIG. 16 is a diagram illustrating an alternate buffering scheme to resolve duty cycle variations in a row driver.

To address this concern, each of the primary row drivers 76A and spare row drivers 76E in a given column may include alternate buffering as illustrated in FIG. 16. If the buffering is alternated, as shown, both clock edges experience almost the same timing error. Thus, the timing error acts as a common mode on both edges, and, essentially, cancels out any timing error as the emission clock signal propagates down the row of μD 78.

Figure 17:
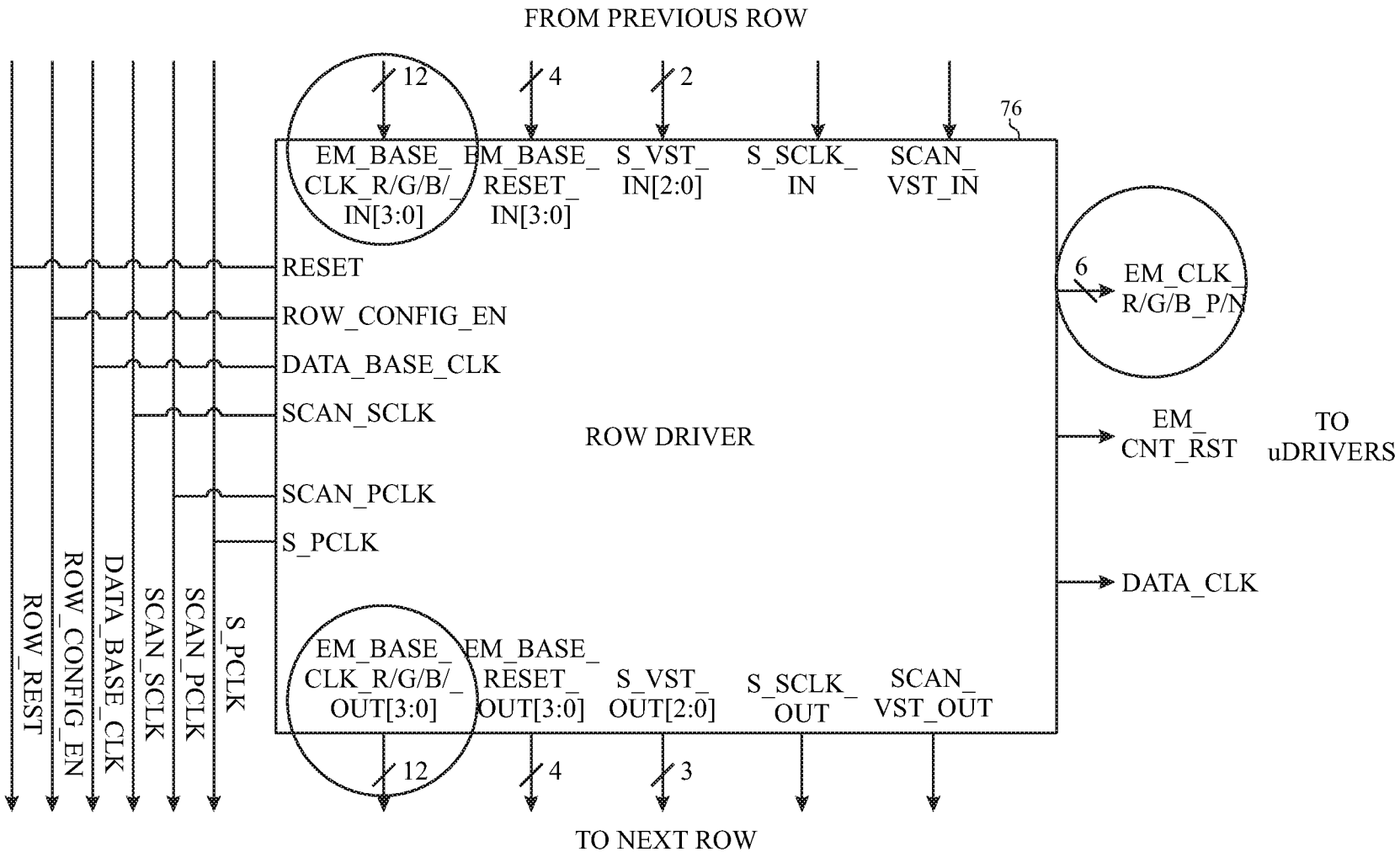
FIG. 17 is a schematic diagram of a present row driver illustrating various inputs and outputs.
Figure 18:
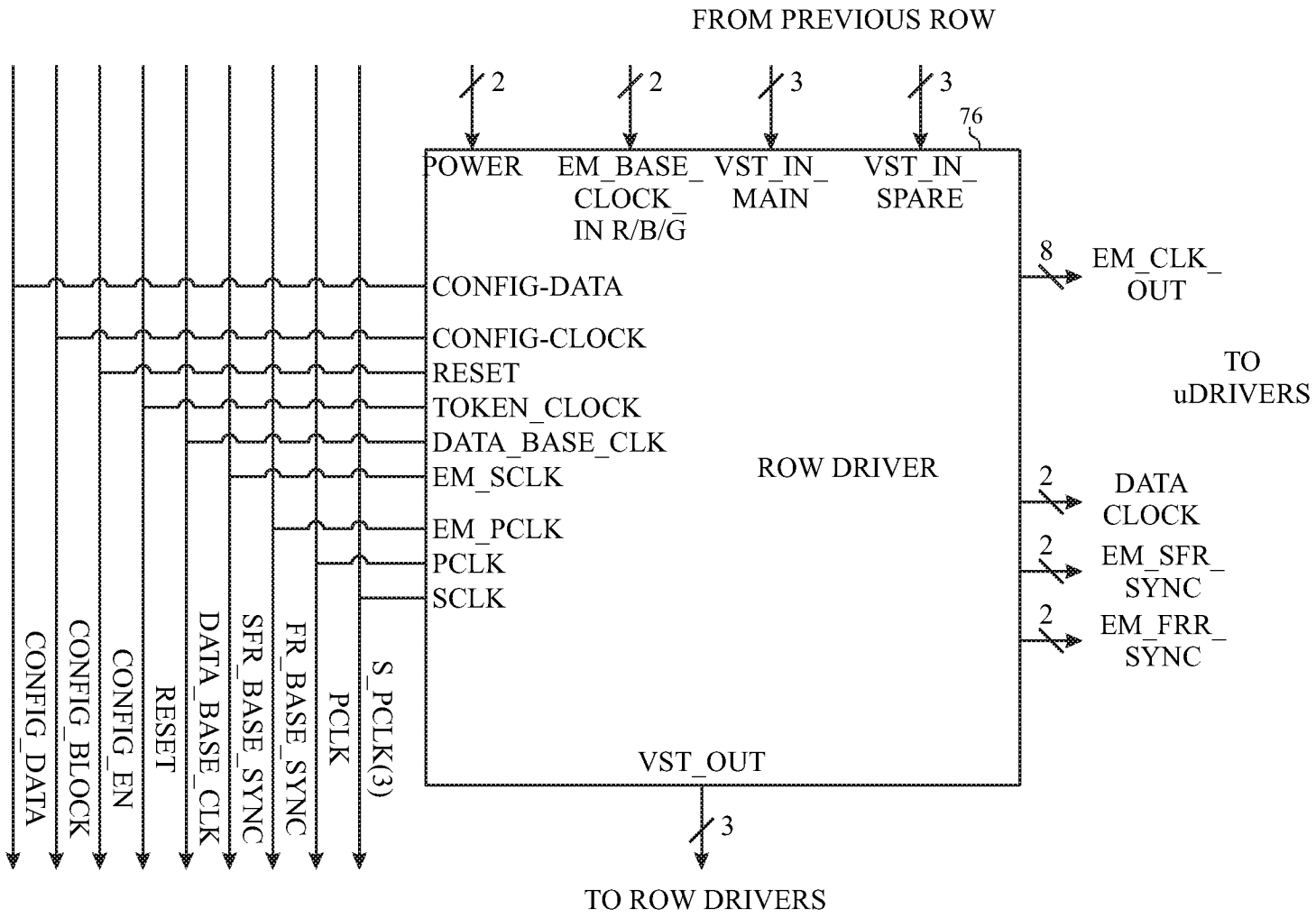
FIG. 18 is a schematic diagram of an improved row driver illustrating various inputs and outputs.

To demonstrate how these various techniques can lead to pin count reductions, a present row driver is illustrated in FIG. 17, and a row driver that operates in accordance with the techniques disclosed above is illustrated in FIG. 18. First, it should be understood that row drivers supporting red pixels may be separate from row drivers supporting blue and green pixels. Second, each row driver receives the proper clock phases used for its operation instead of receiving all clock phases. In other words, the clock phases such as EM_BASE_CLK are hard wired to each row driver of FIG. 17. In the approach shown in FIG. 18, the number of pins may be reduced by using serial inputs for signals such as VST, for instance.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure. Moreover, although the foregoing discusses row drivers that send data to microdrivers and column drivers that control which microdriver in a row receives the data, it should be appreciated that the foregoing discussion about row drivers may be applied to column drivers and vice versa merely by rotating orientation of the display. Thus, recitations of columns and rows may be interchangeable in meaning herein.

What is claimed is:

1. A display comprising:

emission clock circuitry configured to provide a first emission clock phase having a first plurality of pulses occurring over a first emission time period and a second emission clock phase having a second plurality of pulses occurring over a second emission time period, wherein the second emission time period of the second emission clock phase is offset in time from the first emission time period; and a display panel comprising:

a plurality of pixels arranged in an array of pixels disposed in rows and columns;

a first micro-driver of a first array of micro-drivers arranged to drive respective pixels of a first section of the array of pixels based at least in part on pulse width modulation using the first emission clock phase over the first emission time period;

a second micro-driver of a second array of micro-drivers arranged to drive respective pixels of a second section of the array of pixels based at least in part on pulse width modulation using the second emission clock phase over the second emission time period;

a first column of row drivers disposed along a first side of the display panel, wherein a first row driver of the first column of row drivers is configured to drive, for a first set of image data, multiple pulses of the first plurality of pulses of the first emission clock phase to the first micro-driver of the first array of micro-drivers; and a second column of row drivers disposed along a second side of the display panel disposed opposite the first side of the display panel, wherein a second row driver of the second column of row drivers is configured to drive, for the first set of image data and after the first micro-driver receives a first pulse of the first plurality of pulses of the first emission clock phase, multiple pulses of the second plurality of pulses of the second emission clock phase to the second micro-driver of the second array of micro-drivers.

2. The display, as set forth in claim 1, wherein the emission clock circuitry is configured to provide the first emission clock phase and the second emission clock phase to a spare micro-driver communicatively coupled to the first array of micro-drivers when providing the first emission clock phase to the first micro-driver of the first array of micro-drivers.

3. The display, as set forth in claim 1, comprising a first plurality of hard-wired lines operatively coupling the emission clock circuitry to the first column of row drivers and a second plurality of hard-wired lines operatively coupling the emission clock circuitry to the second column of row drivers, wherein the first plurality of hard-wired lines is configured to deliver the first emission clock phase and the second emission clock phase in a non-multiplexed fashion.

4. The display, as set forth in claim 1, wherein each of the plurality of pixels comprises a plurality of subpixels, and wherein each micro-driver is configured to cause the plurality of subpixels of each respective pixel to illuminate based at least in part on a respective emission clock phase of a plurality of emission clock phases including the first emission clock phase and the second emission clock phase.

5. The display, as set forth in claim 1, wherein the first section of the array of pixels comprises half of the plurality of pixels in the array of pixels and is located closer to the first column of row drivers than the second column of row drivers, and wherein the second section of the array of pixels comprises half of the plurality of pixels in the array of pixels and is located closer to the second column of row drivers than the first column of row drivers.

6. The display, as set forth in claim 5, wherein:

the first section of the array of pixels comprises a first subsection and a second subsection, wherein a first plurality of row drivers in the first column of row drivers is configured to drive the first emission clock phase to micro-drivers in the first array of micro-drivers associated with the pixels in the first subsection of the first section of the array of pixels, and wherein a second plurality of row drivers in the first column of row drivers is configured to drive the first emission clock phase to the micro-drivers in the first array of micro-drivers associated with the pixels in the second subsection of the first section of the array of pixels; and the second section of the array of pixels comprises a first subsection and a second subsection, wherein a first plurality of row drivers in the second column of row drivers is configured to drive the second emission clock phase to micro-drivers in the second array of micro-drivers associated with the pixels in the first subsection of the second section of the array of pixels, and wherein a second plurality of row drivers in the second column of row drivers is configured to drive the second emission clock phase to the micro-drivers in the second array of micro-drivers associated with the pixels in the second subsection of the second section of the array of pixels.

7. The display, as set forth in claim 6, wherein the first subsection and second subsection of the first section of the array of pixels comprise a same number of pixels, and wherein the first subsection and second subsection of the second section of the array of pixels comprise the same number of pixels.

8. The display, as set forth in claim 6, wherein the first subsection and second subsection of the first section of the array of pixels comprise a different number of pixels, and wherein the first subsection and second subsection of the second section of the array of pixels comprise a different number of pixels.

9. The display, as set forth in claim 1, comprising:

a third column of spare row drivers disposed adjacent the first column of row drivers, the third column of spare row drivers configured to drive the first emission clock phase to the first array of micro-drivers in response to failure of any respective row drivers in the first column of row drivers; and a fourth column of spare row drivers disposed adjacent the second column of row drivers, the fourth column of spare row drivers configured to drive the second emission clock phase to the second array of micro-drivers in response to failure of any respective row drivers in the second column of row drivers.

10. A display comprising:

emission clock circuitry configured to generate a first emission clock phase corresponding to a first emission time period and a second emission clock phase corresponding to a second emission time period offset in starting time from the first emission time period; and a display panel comprising:

a plurality of pixels arranged in an array of pixels disposed in rows and columns, wherein a first subset of pixels of the plurality of pixels are configurable to emit light in response to a comparison driven by the first emission clock phase;

an array of micro-drivers arranged to drive the array of pixels, wherein the array of micro-drivers comprises a first array of micro-drivers and a second array of micro-drivers;

a first column of row drivers disposed along a first side of the display panel and configured to drive, for a first set of image data, the first emission clock phase to the first array of micro-drivers; and a second column of row drivers disposed along a second side of the display panel disposed opposite the first side of the display panel and configured to drive, for the first set of image data, the second emission clock phase to the second array of micro-drivers, wherein the second array of micro-drivers are configured to start light emission from a second subset of pixels of the plurality of pixels after the first array of micro-drivers start light emission from the first subset of pixels.

11. The display, as set forth in claim 10, wherein the first emission clock phase comprises a contiguous transmission of a first plurality of pulses.

12. The display, as set forth in claim 10, comprising a first plurality of hard-wired lines operatively coupling the emission clock circuitry to the first column of row drivers and a second plurality of hard-wired lines operatively coupling the emission clock circuitry to the second column of row drivers, wherein the first emission clock phase comprises a multi-phase signal, wherein the first plurality of hard-wired lines is configured to deliver the multi-phase signal in a non-multiplexed fashion to the first column of row drivers and the second plurality of hard-wired lines is configured to deliver the multi-phase signal in the non-multiplexed fashion to the second column of row drivers, and wherein a first hard-wired line of the first plurality of hard-wired lines is configured to deliver a first phase of the multi-phase signal to a respective row driver of the first column of row drivers and a second hard-wired line of the second plurality of hard-wired lines is configured to deliver a second phase of the multi-phase signal to a respective row driver of the second column of row drivers.

13. The display, as set forth in claim 10, wherein each of the plurality of pixels comprises a plurality of subpixels, and wherein each micro-driver is configured to cause the plurality of subpixels of each respective pixel to illuminate based at least in part on a respective emission clock phase of a plurality of emission clock phases including the first emission clock phase and the second emission clock phase.

14. The display, as set forth in claim 10, wherein the array of pixels is split into at least a first section and a second section, wherein the first section of the array of pixels and the first array of micro-drivers are located closer to the first column of row drivers than the second column of row drivers, and wherein the second section of the array of pixels and the second array of micro-drivers are located closer to the second column of row drivers than the first column of row drivers.

15. The display, as set forth in claim 14, wherein the first section of the array of pixels and the second section of the array of pixels comprise a same number of pixels, and wherein the first array of micro-drivers and the second array of micro-drivers comprise a same number of micro-drivers.

16. The display, as set forth in claim 14, wherein the first section of the array of pixels and the second section of the array of pixels comprise a different number of pixels, and wherein the first array of micro-drivers and the second array of micro-drivers comprise a different number of micro-drivers.

17. The display, as set forth in claim 14, wherein:

the first section of the array of pixels comprises a first subsection and a second subsection, wherein a first plurality of row drivers in the first column of row drivers is configured to drive the first emission clock phase to micro-drivers in the first array of micro-drivers associated with the pixels in the first subsection of the first section of the array of pixels, and wherein a second plurality of row drivers in the first column of row drivers is configured to drive the first emission clock phase to the micro-drivers in the first array of micro-drivers associated with the pixels in the second subsection of the first section of the array of pixels; and the second section of the array of pixels comprises a first subsection and a second subsection, wherein a first plurality of row drivers in the second column of row drivers is configured to drive the second emission clock phase to micro-drivers in the second array of micro-drivers associated with the pixels in the first subsection of the second section of the array of pixels, and wherein a second plurality of row drivers in the second column of row drivers is configured to drive the second emission clock phase to the micro-drivers in the second array of micro-drivers associated with the pixels in the second subsection of the second section of the array of pixels.

18. The display, as set forth in claim 10, comprising:

a third column of spare row drivers disposed adjacent the first column of row drivers, the third column of spare row drivers configured to drive the first emission clock phase to the first array of micro-drivers in response to failure of any respective row drivers in the first column of row drivers; and a fourth column of spare row drivers disposed adjacent the second column of row drivers, the fourth column of spare row drivers configured to drive the second emission clock phase to the second array of micro-drivers in response to failure of any respective row drivers in the second column of row drivers.

19. A method of operating a display comprising:

generating a first emission clock phase having a first plurality of pulses and a second emission clock phase having a second plurality of pulses, wherein a starting pulse of the first plurality of pulses is offset in time from a starting pulse of the second plurality of pulses causing light emission driven by the second plurality of pulses to start at a time after light emission driven by the first plurality of pulses;

using a first row driver of a first column of row drivers disposed along a first side of the display to drive, for a first set of image data, multiple pulses of the first plurality of pulses of the first emission clock phase to a first micro-driver of a first array of micro-drivers associated with a first array of pixels on the display, wherein the first micro-driver drives a light-emitting diode to emit light in response to a number of pulses of the multiple pulses based at least in part on counter circuitry; and using a second row driver of a second column of row drivers disposed along a second side of the display disposed opposite the first side of the display to drive, for the first set of image data, the multiple pulses of the second plurality of pulses of the second emission clock phase to a second micro-driver of a second array of micro-drivers associated with a second array of pixels on the display.

20. The method, as set forth in claim 19, wherein generating the first emission clock phase and the second emission clock phase comprises generating a multi-phase signal.

21. The method, as set forth in claim 20, comprising:

transmitting the multi-phase signal to the first column of row drivers via a first plurality of hard-wired lines in a non-multiplexed fashion, wherein a first hard-wired line of the first plurality of hard-wired lines is configured to deliver a first phase of the multi-phase signal to a respective row driver of the first column of row drivers; and transmitting the multi-phase signal to the second column of row drivers via a second plurality of hard-wired lines in the non-multiplexed fashion, wherein a second hard-wired line of the second plurality of hard-wired lines is configured to deliver a second phase of the multi-phase signal to a respective row driver of the second column of row drivers.

22. The method, as set forth in claim 20, wherein:

the first array of pixels and the first micro-driver are located closer to the first column of row drivers than the second column of row drivers; and the second array of pixels and the second micro-driver are located closer to the second column of row drivers than the first column of row drivers.

23. The method, as set forth in claim 22, wherein:

the first array of pixels and the second array of pixels comprise the same number of pixels;

the first micro-driver is one of a plurality of micro-drivers in the first array of micro-drivers;

the second micro-driver is one of a plurality of micro-drivers in the second array of micro-drivers; and the first array of micro-drivers and the second array of micro-drivers comprise the same number of micro-drivers.

24. The method, as set forth in claim 22, wherein:

the first array of pixels and the second array of pixels comprise a different number of pixels;

the first micro-driver is one of a plurality of micro-drivers in the first array of micro-drivers;

the second micro-driver is one of a plurality of micro-drivers in the second array of micro-drivers; and the first array of micro-drivers and the second array of micro-drivers comprise a different number of micro-drivers.

* * * * *